US012098599B2

(12) United States Patent
Hammargren

(10) Patent No.: US 12,098,599 B2
(45) Date of Patent: Sep. 24, 2024

(54) SHOULDER PROTECTED DRILLING ASSEMBLY

(71) Applicant: SANDVIK MINING AND CONSTRUCTION TOOLS AB, Sandviken (SE)

(72) Inventor: John Hammargren, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 17/767,726

(22) PCT Filed: Oct. 9, 2020

(86) PCT No.: PCT/EP2020/078402
§ 371 (c)(1),
(2) Date: Apr. 8, 2022

(87) PCT Pub. No.: WO2021/069657
PCT Pub. Date: Apr. 15, 2021

(65) Prior Publication Data

US 2024/0117687 A1 Apr. 11, 2024

(30) Foreign Application Priority Data

Oct. 11, 2019 (EP) ..... 19202722

(51) Int. Cl.
*E21B 17/10* (2006.01)
*E21B 1/00* (2006.01)

(52) U.S. Cl.
CPC ..... *E21B 17/1078* (2013.01); *E21B 1/00* (2013.01)

(58) Field of Classification Search
CPC ..... E21B 17/1078; E21B 1/00; E21B 1/02; E21B 1/12
See application file for complete search history.

(56) References Cited

U.S. PATENT DOCUMENTS

| | | | | |
|---|---|---|---|---|
| 1,849,510 | A | 3/1932 | Morris | |
| 1,943,879 | A | 1/1934 | Rea | |
| 4,413,689 | A * | 11/1983 | Hughes | E21B 10/38 175/425 |
| 6,202,768 | B1 | 3/2001 | Lindgren et al. | |
| 2001/0018990 | A1 * | 9/2001 | Asberg | E21B 10/38 175/420.1 |

(Continued)

FOREIGN PATENT DOCUMENTS

| | | | |
|---|---|---|---|
| CN | 106150395 | B | 8/2018 |
| GB | 2127463 | A | 4/1984 |

(Continued)

OTHER PUBLICATIONS

Boart Longyear Top Hammer Drilling Tools (Year: 2015).*

*Primary Examiner* — David Carroll
(74) *Attorney, Agent, or Firm* — Corinne R. Gorski

(57) ABSTRACT

A drilling assembly for percussive drilling includes at least two of a drill bit, a drill rod and a guide adapter. A peripheral surface of the shoulder on the drill rod is at least partially encased in both radial and axial directions inside the mounting sleeve of the drill bit or the mounting sleeve of the guide adapter, and/or the peripheral surface of the shoulder on the guide adapter is at least partially encased in both radial and axial directions inside the mounting sleeve of the drill bit.

12 Claims, 11 Drawing Sheets

(56) References Cited

U.S. PATENT DOCUMENTS

| | | | | |
|---|---|---|---|---|
| 2012/0247835 | A1 | 10/2012 | Boehm et al. | |
| 2013/0098689 | A1 | 4/2013 | Karpeilus et al. | |
| 2016/0298390 | A1* | 10/2016 | Kraft | E21B 4/14 |
| 2017/0089149 | A1* | 3/2017 | Yao | E21B 17/0426 |
| 2017/0321496 | A1 | 11/2017 | Mattson et al. | |

FOREIGN PATENT DOCUMENTS

| | | | |
|---|---|---|---|
| WO | 2019016230 | A1 | 1/2019 |
| WO | 2021069657 | A1 | 4/2021 |

* cited by examiner

SHOULDER PROTECTED DRILLING ASSEMBLY

RELATED APPLICATION DATA

This application is a § 371 National Stage Application of PCT International Application No. PCT/EP2020/078402 filed Oct. 9, 2020 claiming priority to EP 19202722.5 filed Oct. 11, 2019.

TECHNICAL FIELD

This invention relates to a percussive drilling assembly and, although not exclusively, especially to a rock drill bit and/or guide adapter for top hammer drilling.

BACKGROUND OF THE INVENTION

Percussion drill bits are widely used both for drilling relatively shallow bores in hard rock and for creating deep boreholes. For the latter application, drill strings are typically used in which a plurality of rods are interconnected to advance the drill bit and increase the depth of the hole. In 'top hammer drilling' a terrestrial machine is operative to transfer a combined impact and rotary drive motion to an upper end of the drill string whilst a drill bit positioned at the lower end is operative to crush the rock and form the boreholes. Guide adapters may be included between the first drill rod and the drill bit to improve the straightness and quality of the hole drilled.

Drill rods, that are connectable to neighbouring drill rods and the drill bit or guide adapter, can have a shoulder. If a guide adapter is included, it will also have a shoulder. The shoulder is formed as a radially flared extension of the main length section of the drill rod or on guide adapter to provide increased efficiency in energy transfer between the drill rod and the drill bit or guide adapter or between the guide adapter and the drill bit. The shoulder on the first drill string rod that joins to the drill bit or guide adapter and the shoulder on the guide adapter is exposed to high levels of wear as the hole collapses and rock cuttings gather behind the drill bit. The problem with this is that as the shoulder wears the strength of the coupling will weaken prematurely. Additionally, as the shoulder wears away the contact area between the drill string rod and the drill bit or guide adapter or between the guide adapter and the drill bit decreases and therefore the transfer of the energy between the drill bit or guide adapter and rod or between the guide adapter and drill bit decreases, if the transfer of energy is not efficient energy will be wasted and the drilling efficiency will be compromised.

Therefore, there exists a need for a drilling assembly design where the wear to the shoulder on the drill string rod and/or on guide adapter is reduced. One known solution is to hard face the peripheral edge of the shoulder; however, this adds considerably additional costs to the production of the drill string rod or guide adapter. Accordingly, there exists a need for a drilling assembly design where the wear to the shoulder of the drill rod and/or guide adapter is reduced without adding significant addition production costs.

SUMMARY

It is an objective of this invention to provide a novel and improved percussive drilling assembly and apparatus where the shoulder on the first rod that is connected to the drill bit or guide adapter is less prone to wear and/or where the shoulder on the guide adapter that is connected to the drill bit is less prone to wear.

The objective is achieved by providing a drilling assembly for percussive drilling, comprising a at least two of a drill bit, a drill rod and a guide adapter;

- the drill rod comprising a hollow elongate main length section extending axially between a male end and a female end; the male end comprising a male connecting means and a radially projecting shoulder that axially separates the main length section and the male connecting means;
- the shoulder comprising a peripheral surface having a greater outer diameter, $D_1$ than the outer diameter of the main length section, $D_2$, a first annular side surface that abuts the drill bit or guide adapter and a second annular side surface that flares radially from the main length section;
- the drill bit comprising a mounting sleeve for connecting to the drill rod or to the guide adapter;
- the guide adapter comprising a mounting sleeve for connection to the drill rod and a shoulder having a peripheral surface for connection to the drill bit;

characterized in that:

- the peripheral surface of the shoulder on the drill rod is at least partially encased in both radial and axial directions inside the mounting sleeve of the drill bit or the mounting sleeve of the guide adapter;

and/or

- the peripheral surface of the shoulder on the guide adapter is at least partially encased in both radial and axial directions inside the mounting sleeve of the drill bit.

Advantageously, if the shoulder of the drill rod is at least partially encased inside the mounting sleeve of the drill bit or guide adapter the shoulder and/or if the shoulder of the guide adapter is at least partially encased inside the mounting sleeve of the drill bit it is protected from exposure to wear from rock cuttings. This is beneficial as it reduces the risk of premature failure of the drill rod and/or guide adapter. Further, as the shoulder is no longer subject to being worn away, the contact area between the shoulder and the mounting sleeve is constant, which means that there is no reduction in the efficiency of the energy transfer between the two parts so a higher level of drilling efficiency is maintained.

Preferably, at least 20%, more preferably at least 30%, even more preferably at least 50%, even more preferably at least 75%, most preferably at least 90% of the length of the peripheral surface of the shoulder is encased inside the mounting sleeve. If less than 20% of the length of the peripheral surface of the shoulder is encased, then the level of protection will not be sufficient to gain the benefit of reducing wear to the shoulder. By increasing the proportion of the shoulder that is encased inside mounting sleeve the higher the level of protection to wear will be achieved.

Preferably, the mounting sleeve on the drill bit and/or the guide adapter has a connecting section, having a first wall thickness at its thinnest point, for securing to the male connecting means on the drill rod and an encasing section, having a second wall thickness at its thickest point, for the shoulder of the drill rod to fit inside, wherein the second wall thickness is less than the first wall thickness.

Advantageously, the inside geometry of the female sleeve on the drill bit or guide adapter must be able to encase the shoulder from wear.

Preferably, the second wall thickness is at least 1.5 mm. If the second wall thickness is less than 1.5 mm there is an increased risk of cracking in this region.

Preferably, the encasing section has a length $L_1$ and the shoulder has a length $L_2$, wherein $L_1$ is at least 20%, more preferably at least 30%, more preferably at least 50%, even more preferably at least 70%, most preferably at least 90% of $L_2$.

Preferably, the shoulder has an outer diameter $D_1$ and encasing section has an inside diameter $D_3$, wherein $D_1$ is within the range of 80-100%, preferably 95-99% of $D_3$.

If the outer diameter of the shoulder is too large compared to the inside diameter of the encasing section the fit between the shoulder and the mounting sleeve will be too tight and it will make uncoupling of the parts difficult. If the outer diameter of the shoulder is too small compared to the inside diameter of the encasing section the wall of the mounting sleeve in the encasing section will become too thin which increases the risk of cracking in this section.

Preferably, the clearance between the peripheral surface of the shoulder and an internal surface of the encasing section is between 0.5-4 mm. If the clearance is too small the fit between the shoulder and the mounting sleeve will be too tight and it will make uncoupling of the parts difficult. If the clearance is too large the wall of the mounting sleeve will become too thin which increases the risk of cracking in this section and the connection between the two surfaces will not be sufficient to maximize the transfer of energy between the two connecting parts.

Optionally, the peripheral surface of the shoulder and the internal surface of the encasing section are substantially cylindrical. The cylindrical profiles could either have uniform diameters along their axial lengths or could be stepped, so that at the peripheral surface of the shoulder and the internal surface of the encasing section have at least two sections, each section having a different diameter compared to the other sections but having a uniform diameter along the axial length of each section. The profile of the peripheral surface of the shoulder is designed to match and fit inside the profile of the internal surface of the encasing section.

Alternatively, the peripheral surface of the shoulder and the internal surface of the encasing section have a conical shape. The profile of the peripheral surface of the shoulder is designed to match and fit inside the profile of the internal surface of the encasing section.

Preferably, the junction between the edges of the peripheral surface and the first annular side surface and between the edges of the peripheral surface and the second annular side surface on the shoulder are chamfered or rounded off. Advantageously, this reduces the risk of chipping and breakage in these regions.

Preferably, the length of the shoulder is between 5-60 mm, more preferably between 15-25 mm. If the length of the shoulder is too short there is an increased risk of chipping or cracking occurring to the shoulder. If the length of the shoulder is too long unnecessary expense is added. The most preferred length of the shoulder will depend on the thread size being used.

Optionally, the male connecting means on the drill rod is a spigot having an externally threaded section and a non-threaded shank positioned axially between the threaded section and the shoulder and wherein the mounting sleeve on the drill bit or guide adapter is internally threaded. This mounting option is preferred for larger drill bits.

Optionally, the male connecting means on the drill rod is conical and non-threaded and the mounting sleeve on the drill bit or guide adapter is internally conical and non-threaded, forming a tapered connection. This type of connection would typically be used for smaller drill bits.

Preferably, the first annular side surface of the shoulder abuts an annular endmost surface on the connecting section of the mounting sleeve on the drill bit or guide adapter. Advantageously, this will mean that the shoulder is encased inside the drill bit or guide adapter.

Preferably, the drill bit or guide adapter has an outer diameter, $D_4$ at its annular rearward end in the section surrounding the encasing section, wherein $D_4$ is at least 5% greater than the outer diameter, $D_1$, of the shoulder, preferably $D_4$ is at least 3 mm greater than $D_1$ up to a maximum of the diameter of the drill bit or guide adapter at its largest cross section. This will provide the protection to the shoulder.

It should be understood that the shoulder could be either the shoulder on the drill rod or on the guide adapter and the mounting sleeve could be either on the drill bit or the guide adapter.

Another aspect of the present invention relates to a drill bit or guide adapter having a mounting sleeve that has a has a connecting section, having a first wall thickness, $T_1$, at its thinnest point, for securing to the male connecting means on the drill rod and an encasing section, having a second wall thickness, $T_2$, at its thickest point, for the shoulder of the drill rod to fit inside, wherein the second wall thickness, $T_2$, is less than the first wall thickness, $T_1$.

DETAILED DESCRIPTION

Figure 1:
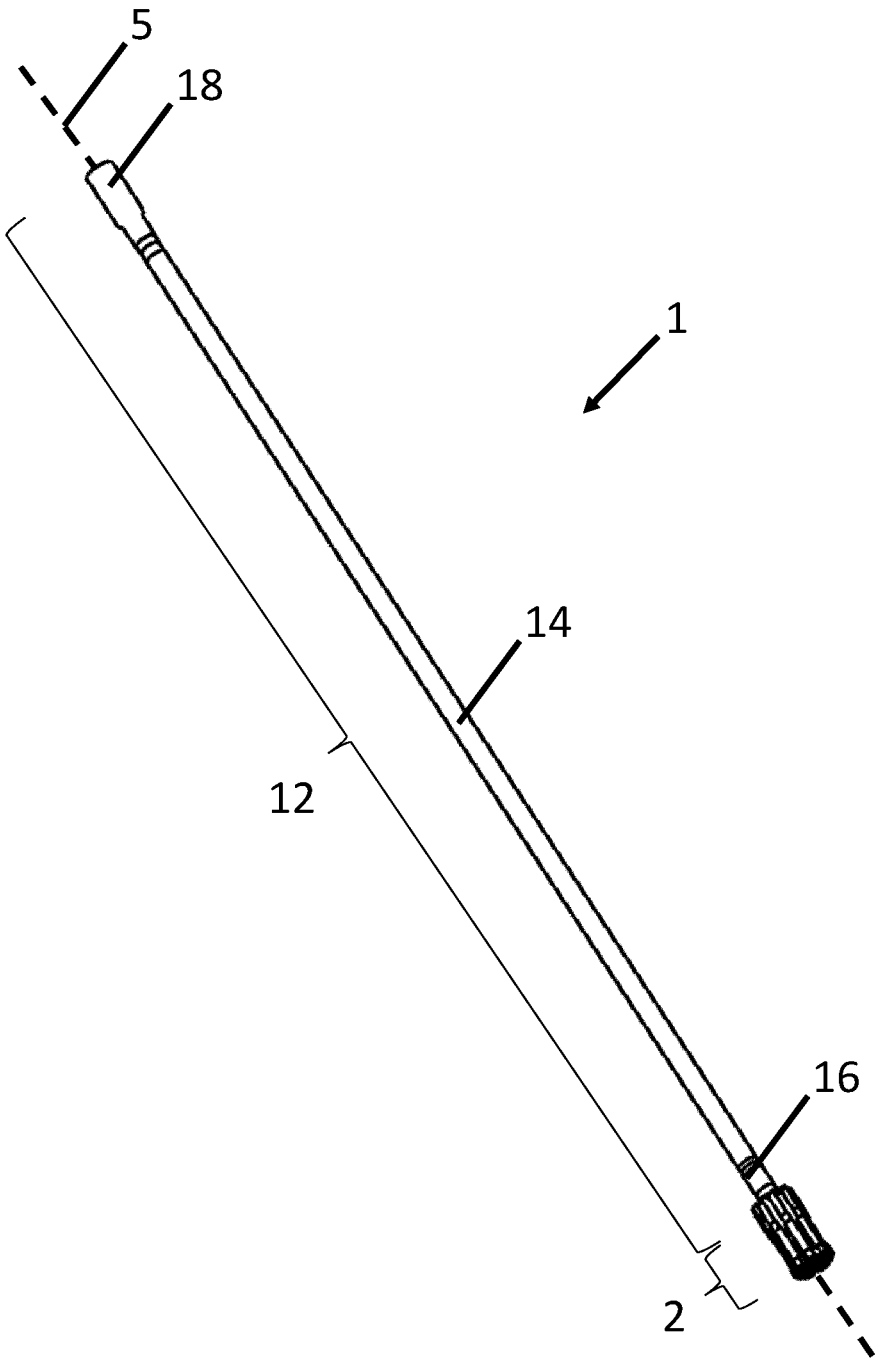
FIG. 1: shows a perspective view of a percussive drilling assembly wherein a drill rod is coupled to drill bit.

FIG. 1 shows a percussive drilling assembly 1 whereby a first drill rod 12 is releasably coupled to a drill bit 2 of conventional design. The percussive drilling assembly 1 is especially used for top hammer drilling. Shockwaves generated by a surface piston (not shown) are translated through the mated surfaces from the drill rod 12 to the drill bit 2. The drill rod 12 comprises an axially extending main length section 14 that is terminated at one end by a male end 16 and at a second opposite end by a female end 18 having a longitudinal axis 5. The drill rod 12 is capable of being coupled end-to-end with other adjacent drill rods 12 to form a drill string (not shown).

Figure 2:
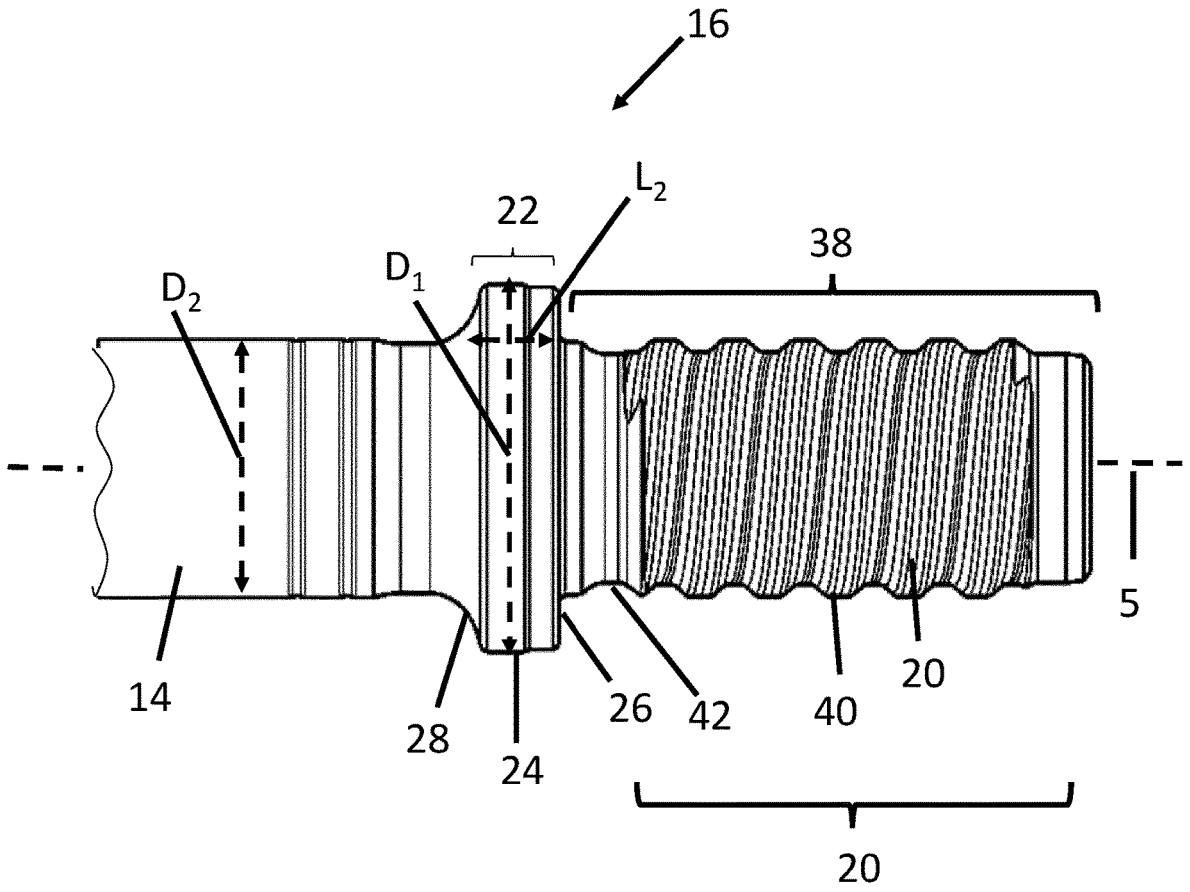
FIG. 2: shows a perspective view of the male end of a drill rod.

FIG. 2 shows the male end 16 of the drill rod 12 comprising a male connecting means 20, in this case in the form of a spigot 38 and a shoulder 22 that projects radially outward relative to the main length section 14, that extends over a fraction of the axial distance of the main length section 14. The shoulder 22 comprises a peripheral surface 24 that extends axially along the length of the shoulder 22, a first annular side surface 26 at the forwardmost end of the shoulder 22 that abuts the drill bit 2 adjacent to the male connection means 20, alternatively called an annular abutment surface, and a second annular side surface 28 that flares radially from the main length section 14. The main length section 14, has an outer diameter $D_2$, the shoulder 22 has a length $L_2$ and an outer diameter $D_1$. The drill rod 12 has an internal bore (not shown) that extends axially through the main length section 14, optionally the bore has a uniform diameter over its entire axial length.

Preferably, the corner or junction between the edges of the peripheral surface 24 and the first annular side surface 26 and between the peripheral surface 24 and the second annular side surface 26 on the shoulder 22 are chamfered.

Figure 3:
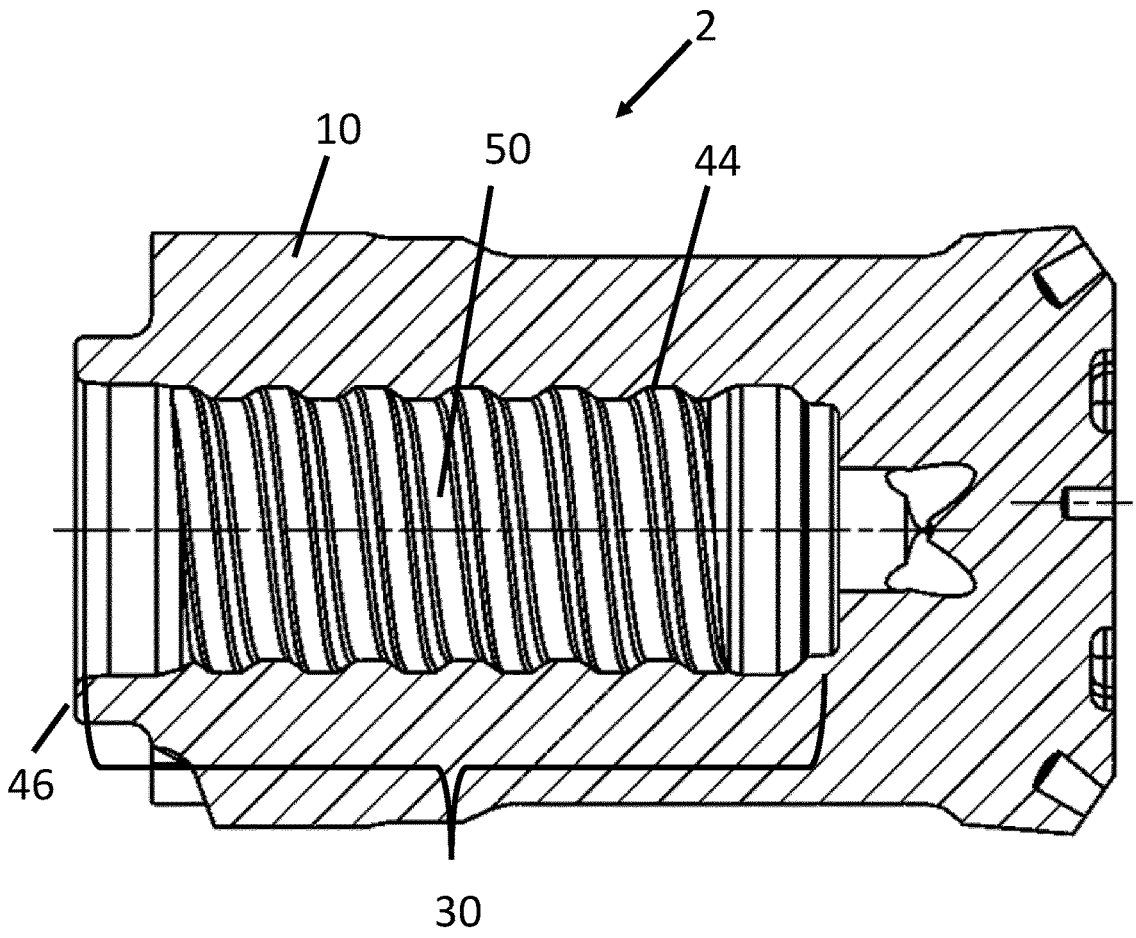
(Prior art) Fig 3
FIG. 3: shows a cross section of a drill bit as known in the prior art.
Figure 5:
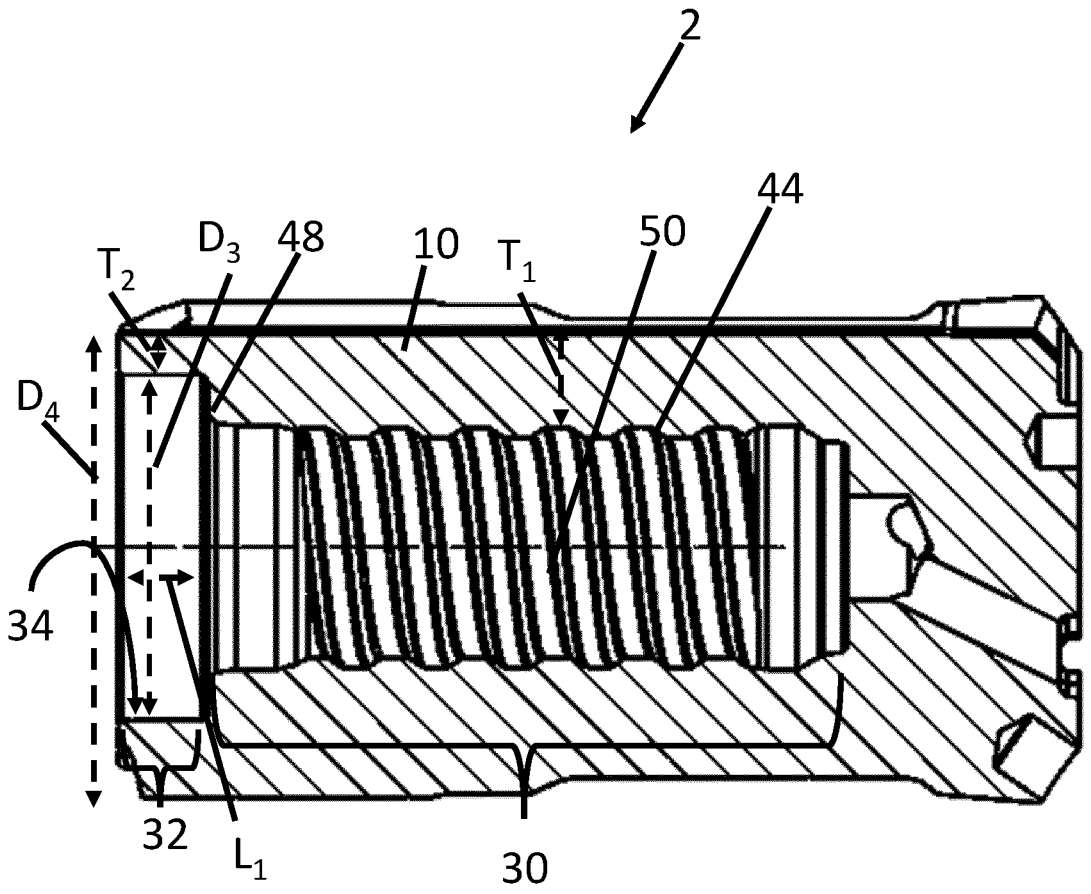
FIG. 5: shows a cross section of a drill bit according to an embodiment of the present invention wherein the mounting sleeve is internally threaded.

FIG. 3 shows the cross section of the drill bit 2 as known in the prior art and FIG. 5 shows the cross section of drill bit 2 according to one embodiment of the present invention. In both versions the drill bit 2 comprises an axially forwardmost drill head of convention design for example comprising a rock crushing means, most typically this is a plurality of wear resistant cutting buttons projecting axially forward from the drill head (not shown); a plurality of grooves extending in the axial direction of the drill bit used for the removal of sludge and drill cuttings (not shown)); and a mounting sleeve 10 that comprises an internal cavity 50 extending axially from the axially rearward endmost surface 46 to receive the male connecting means 20 of the drill rod 12.

In the version known in the prior art shown, as shown in FIG. 3, the mounting sleeve 10 has a connecting section 30 suitable for coupling to the male connecting means 20 of the drill rod 12.

Figure 4:
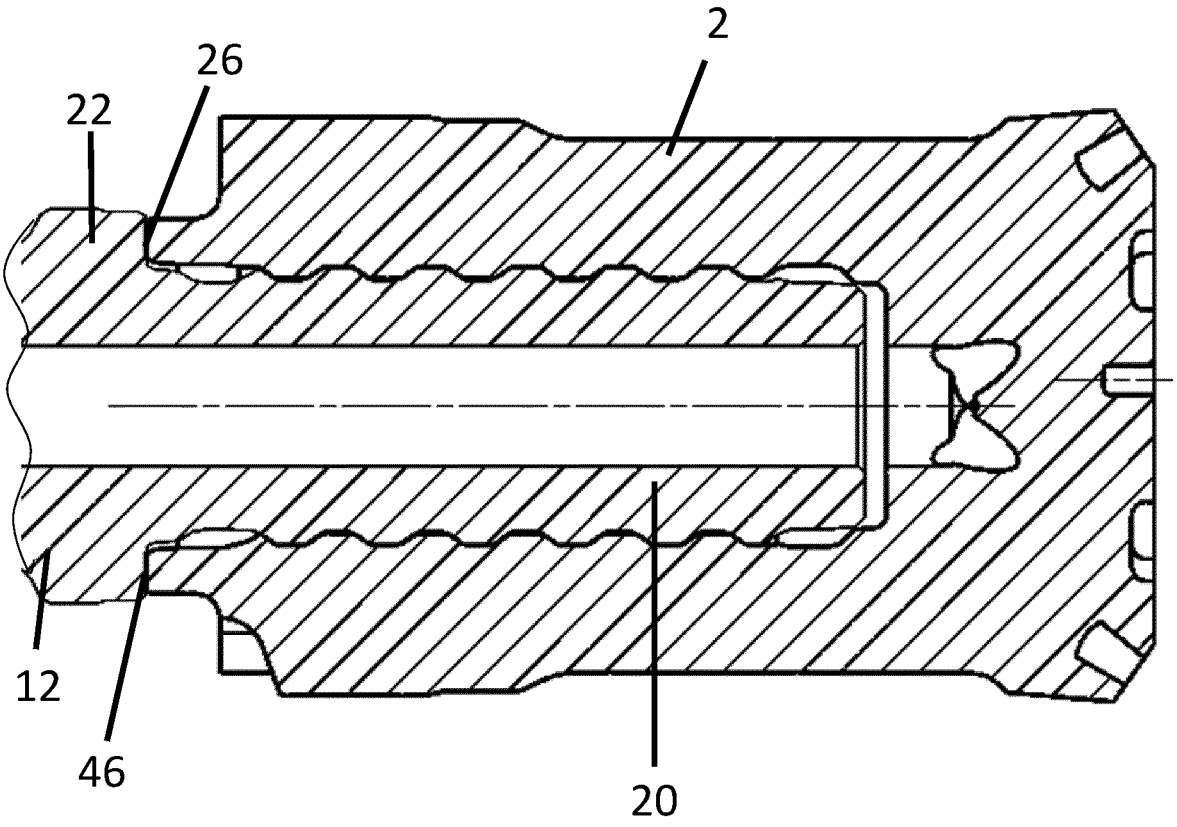
(Prior art) Fig 4
FIG. 4: shows a cross section of a drill bit coupled to the first drill rod as known in the prior art.

FIG. 4 shows the drill bit 2 known in the prior art (as shown in FIG. 3) releasably connected to the drill rod 12 wherein the first annular side surface 26 shoulder 22 of the drill rod 12 abuts the annular endmost surface 46 of the drill bit 2 such that a "shoulder contact" is formed.

In the version according to one embodiment of the present invention, as shown in FIG. 5, the mounting sleeve 10 is modified so that it has a connecting section 30 suitable for coupling to the male connecting means 20 of the drill rod 12 and additionally also has an encasing section 32 suitable for the shoulder 22 of the drill rod 12 to fit inside. The connecting section has a wall thickness $T_1$ at its thinnest point, that is thicker than the wall thickness $T_2$ of the encasing section 32, at its thickest point. Preferably, $T_1$ is at least 10% greater than $T_2$.

Figure 6:
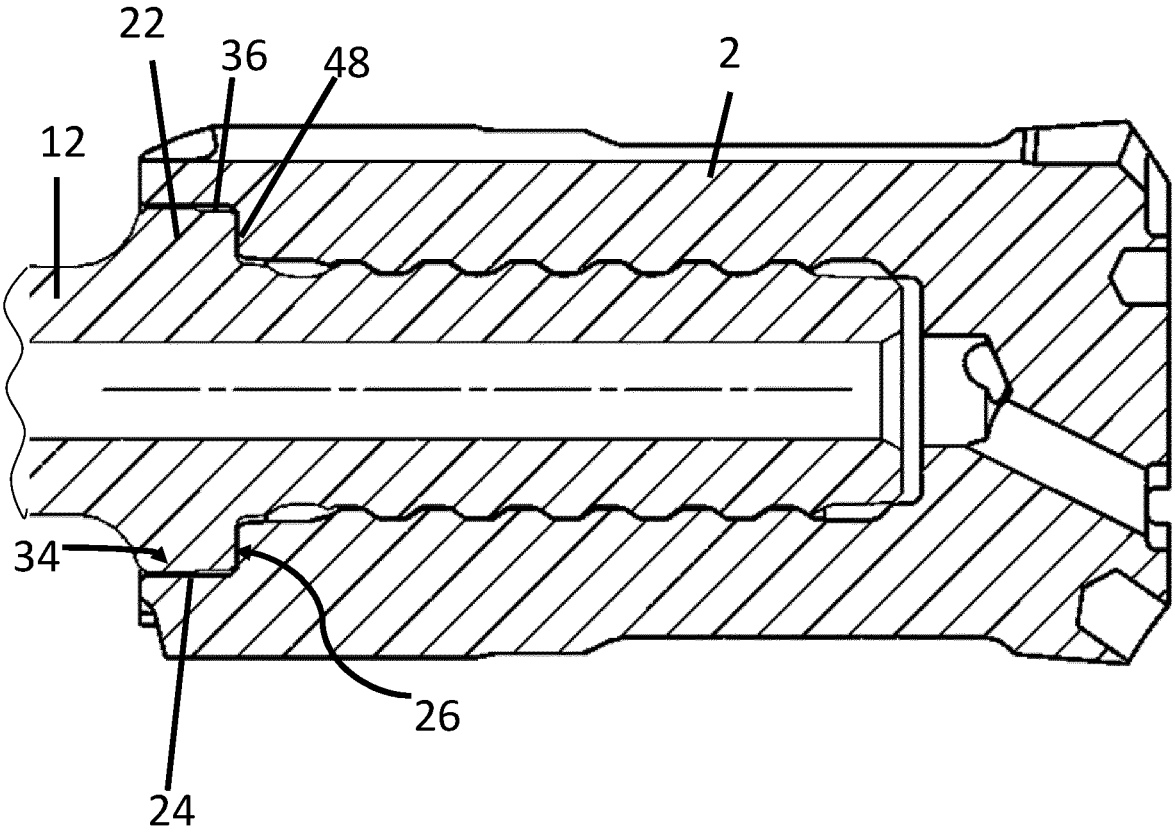
FIG. 6: shows a cross section of a drill bit coupled to the first drill rod according to an embodiment of the present invention having a threaded connection and a cylindrical shoulder.

FIG. 6 shows the drill bit 2 according to an embodiment of the present invention whereby the modified drill bit 2, as shown in FIG. 5, is releasably coupled to the drill rod 12 so that the shoulder 22 of the drill rod 12 is at least partially encased in both the radial and axial directions inside the drill bit 2. In other words, the drill rod 12 is at least partially enclosed inside the drill bit 2 in both radial and axial directions, so that the drill rod 12 is inserted inside at least part of the drill bit 2. The first annular side surface 26 of the shoulder 22 on the drill rod 12 now abuts an annular endmost surface 48 of the connecting section 30. Preferably, at least 20%, more preferably at least 30%, more preferably at least 50%, even more preferably at least 75%, most preferably at least 90% of the length $L_2$ of the shoulder 22 is encased or enclosed inside the mounting sleeve 10 within the encasing section 32.

The encasing section 32 has a length $L_1$. Preferably, the length of the encasing section $L_1$ is at least 20% of the length of the shoulder $L_2$, more preferably at least 30%, more preferably at least 50%, even more preferably at least 75%, most preferably at least 90%. Preferably, $L_2$ is 15 to 22 mm, more preferably about 22 mm.

The encasing section 32 has an inside diameter $D_3$. Preferably the outer diameter $D_1$ of the shoulder 22 is within the range of 80-100% of $D_3$, more preferably 95-99%. The clearance 36, which is the radial distance between the peripheral surface 24 of the shoulder 22 and an internal surface 34 of the encasing section 32, is preferably between 0.5-4 mm. The drill bit 2 has an outer diameter, $D_4$ at its annular rearward end, in the section surrounding the encasing section 32. Preferably, $D_4$ is at least 5% greater than $D_1$. Preferably, $D_4$ is at least 3 mm larger than $D_1$, up to a maximum of the diameter of the drill bit 2 at its largest cross section.

In one embodiment, the peripheral surface 24 of the shoulder 22 and the internal surface 34 of the encasing section 32 are both substantially cylindrical as shown in FIG. 6. If the shoulder 22 and encasing section 32 are substantially cylindrical they could either have a uniform diameter along there is a stepped profile such that the peripheral surface 24 of the shoulder 22 and the internal surface 34 of the encasing section 32 have at least two sections, each section having a different diameter compared to the other sections, but having a uniform diameter along the axial length of each section.

Figure 7:
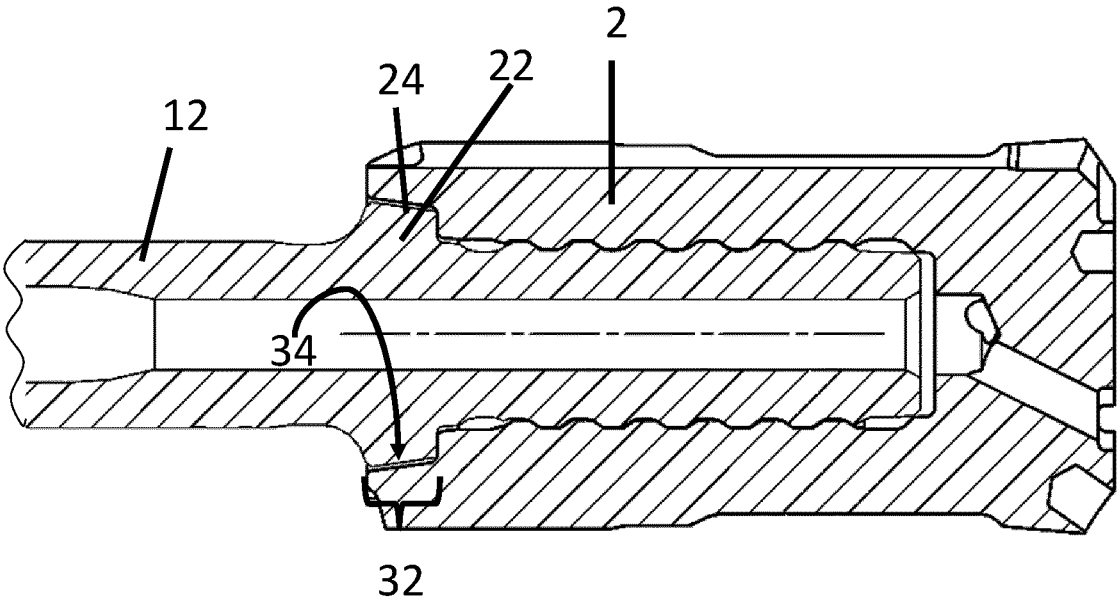
FIG. 7: shows a cross section of a drill bit coupled to the first drill rod according to an alternative embodiment of the present invention having a threaded connection and a conical shoulder.

FIG. 7 shows an alternative embodiment wherein the peripheral surface 24 of the shoulder 22 and the internal surface 34 of the encasing section 32 have a conical shape, having either straight or curved profile.

In one embodiment, as shown in FIGS. 2, 5, 6 and 7 the coupling between the drill bit 2 and the drill rod 12 is formed by the threaded connection. In this embodiment the male connecting means 20 on the drill rod 12 is a spigot 38 that projects axially forward from the shoulder 22. The spigot 38 has an externally threaded section 40 and a non-threaded shank 42 positioned axially between the threaded section 40 and the shoulder 22. To couple with this the cavity 50 inside the mounting sleeve 10 on the drill bit 2 is internally threaded 44.

Figure 8:
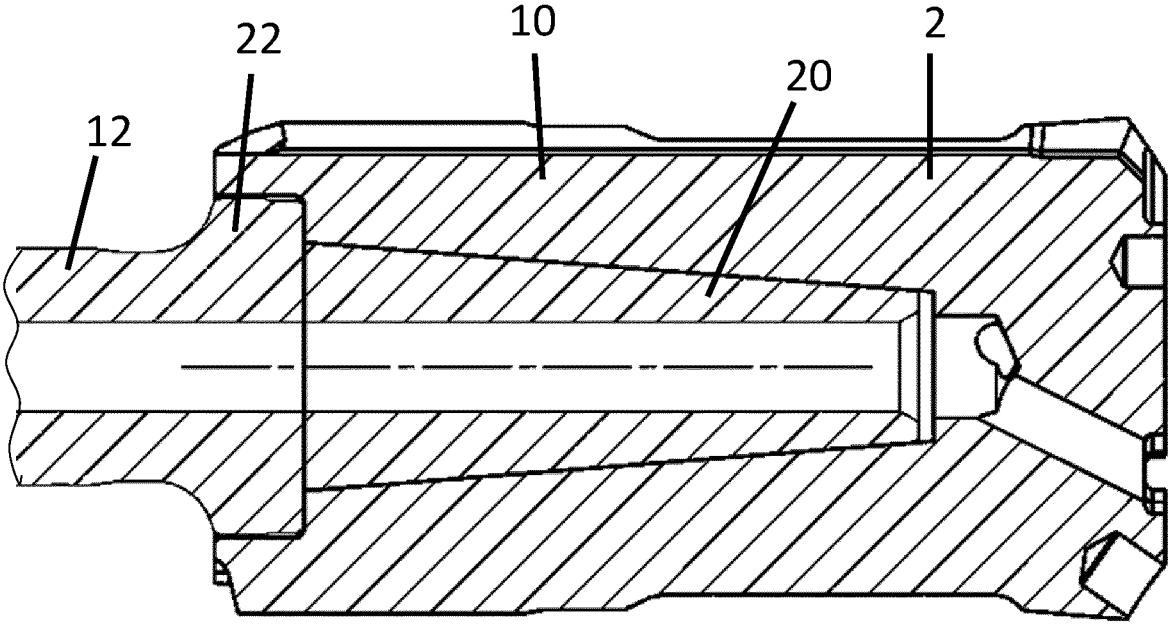
FIG. 8: shows a cross section of a drill bit coupled to the first drill rod according to an alternative embodiment of the present invention having a tapered conical connection.

FIG. 8 shows an alternative embodiment, wherein instead of a threaded coupling, a tapered connection is formed. In this embodiment the male connecting means 20 on the drill rod 12 is conical and non-threaded and mounting sleeve 10 is internally conical and non-threaded, so that the parts are held together by friction.

Any other suitable connecting means could also be used. Any type of connecting means could be combined with any of the profiles of the shoulder 22.

Figure 9:
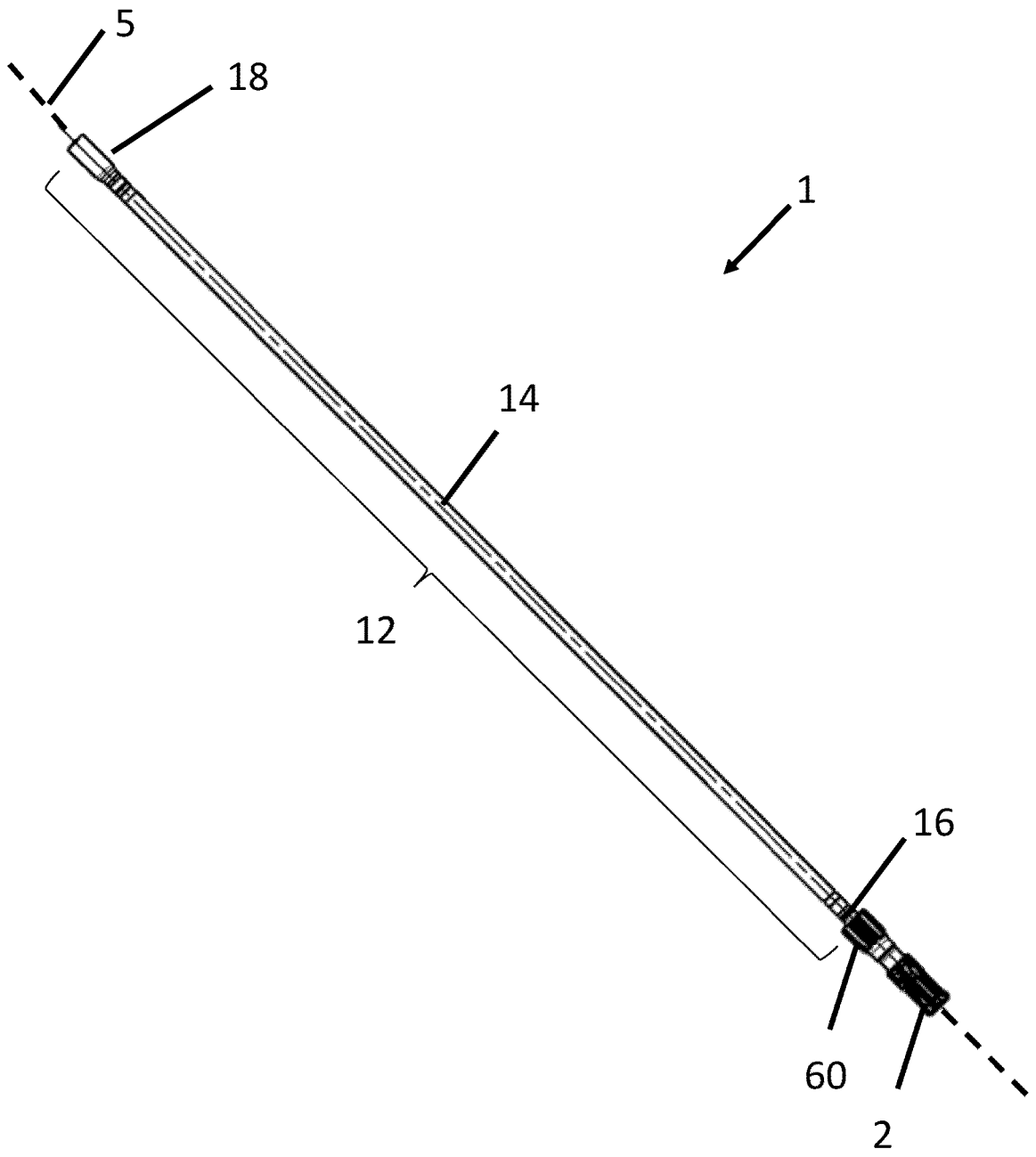
FIG. 9: shows a perspective view a drilling assembly wherein a drill rod is coupled to a drill bit via a guide adapter.
Figure 10:
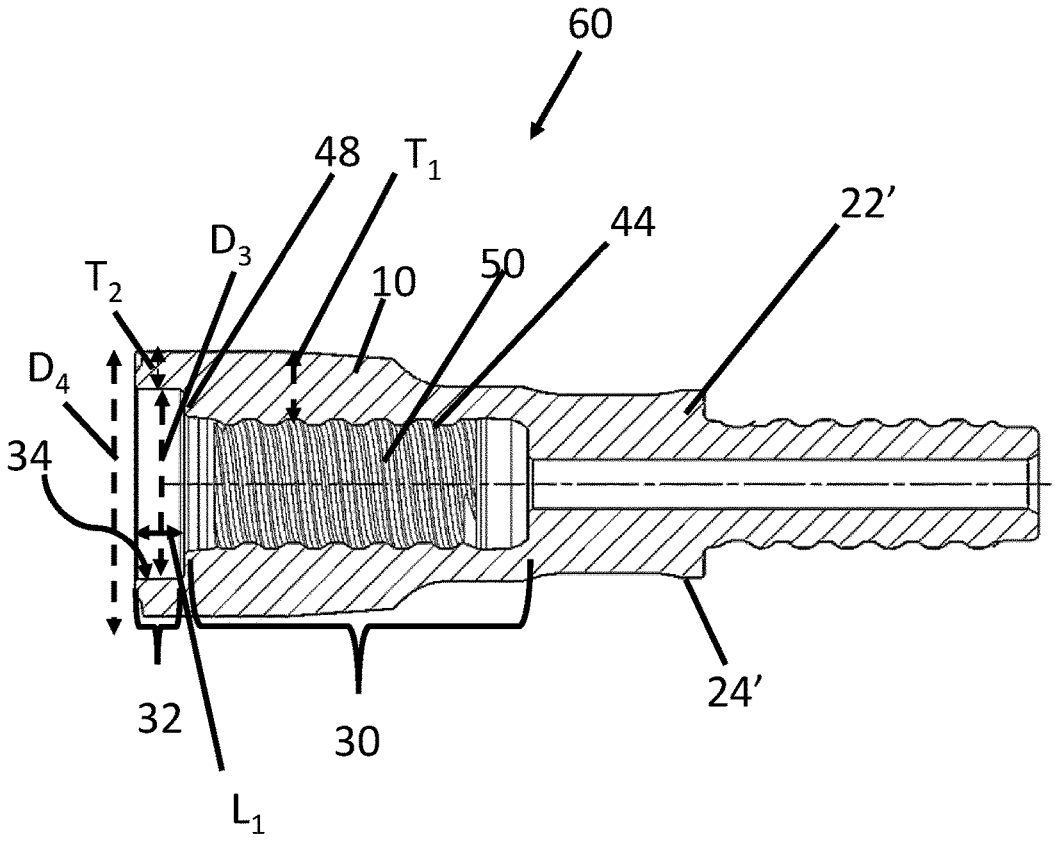
FIG. 10: shows a cross section of a guide adapter according to an embodiment of the present invention.
Figure 11:
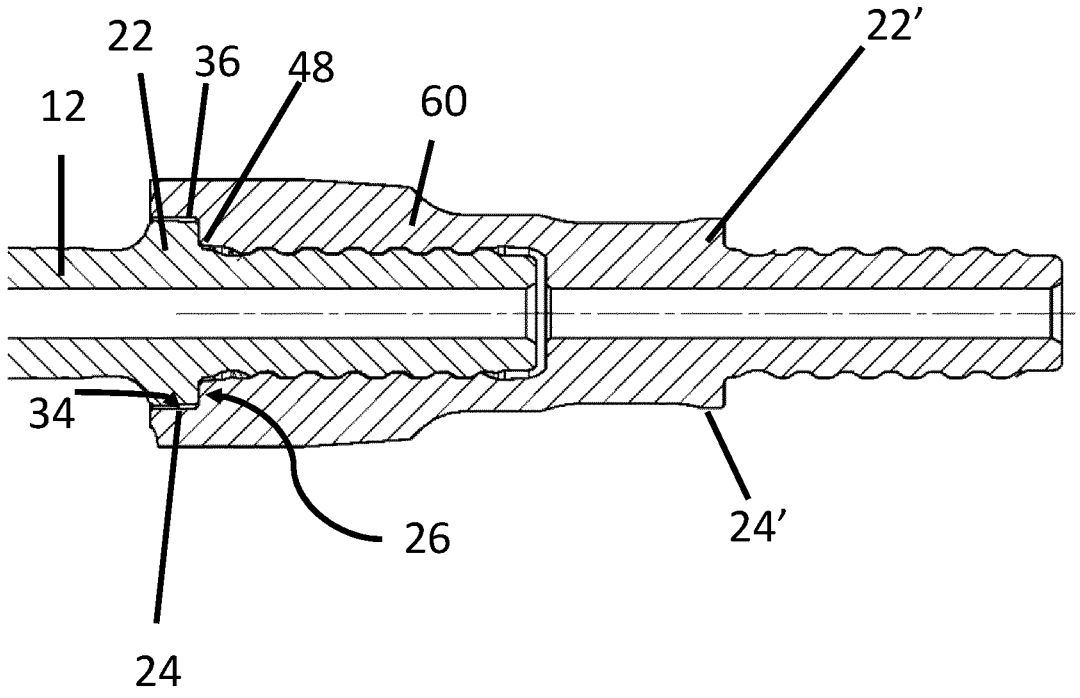
FIG. 11: shows a cross section of a guide adapter coupled to the first drill rod according to an embodiment of the present invention.

FIG. 9 shows can alternatively the drill bit 2 may be connected to the drill rod 12 via a guide adapter 60 having a mounting sleeve 10. FIG. 10 shows that the mounting sleeve 10 is modified in the same way as described hereinabove in relation to the drill bit 2 so that it has a connecting section 30 suitable for coupling to the male connecting means 20 of the drill rod 12 and additionally also has an encasing section 32 suitable for the shoulder 22 of the drill rod 12 to fit inside. FIG. 11 shows the guide adapter 60 according to an embodiment of the present invention whereby the modified guide adapter 60, as shown in FIG. 10, is releasably coupled to the drill rod 12 so that the shoulder 22 of the drill rod 12 is at least partially encased in both the radial and axial directions inside the guide adapter 60. The guide adapter 60 also has a shoulder 22' having a peripheral surface 24' for connection to the drill bit 2. The shoulder 22' on the guide adapter could also be protected from wear by using the drill bit 2 design described hereinabove so that the peripheral surface 24' of the shoulder 22' on the guide adapter 60 is at least partially encased in both radial and axial directions inside the mounting sleeve 10 of the drill bit 2. It should be understood that any of the alternative embodiments described hereinabove above in relation to the drill bit 2 could also be applied to the guide adapter 60.

The invention claimed is:

1. A drilling assembly for percussive drilling, comprising:

at least two components selected from a drill bit, a drill rod and a guide adapter;

the drill rod including a hollow elongate main length section extending axially between a male end and a female end, the male end including a male connecting means and a radially projecting shoulder that axially separates the main length section and the male connecting means, wherein the shoulder includes a peripheral surface having a greater outer diameter ($D_1$) than an outer diameter of the main length section ($D_2$), a first annular side surface that abuts the drill bit or guide adapter and a second annular side surface that flares radially from the main length section;

the drill bit including a mounting sleeve, wherein the mounting sleeve is arranged for connecting the drill rod or the guide adapter; and the guide adapter including the mounting sleeve and a shoulder, wherein the mounting sleeve is arranged for connection to the drill rod, the guide adaptor shoulder having a peripheral surface arranged for connection to the drill bit, wherein the peripheral surface of the shoulder on the drill rod is at least partially encased in both radial and axial directions inside the mounting sleeve of the drill bit or the mounting sleeve of the guide adapter, and/or wherein the peripheral surface of the shoulder on the guide adapter is at least partially encased in both radial and axial directions inside the mounting sleeve of the drill bit, wherein the mounting sleeve on the drill bit or mounting sleeve of the guide adapter has a connecting section having a first wall thickness at its thinnest point, the connecting section being arranged for securing to the male connecting means on the drill rod, and an encasing section having a second wall thickness at its thickest point for the shoulder of the drill rod to fit inside, wherein the second wall thickness is less than the first wall thickness, wherein the peripheral surface of the shoulder of the drill rod or guide adapter and the internal surface of the encasing section are substantially cylindrical, and wherein the first annular side surface of the shoulder on the drill rod abuts an annular endmost surface on the connecting section of the mounting sleeve on the drill bit or the guide adapter.

2. The drilling assembly according to claim 1, wherein at least 20% of a length ($L_2$) of the peripheral surface of the shoulder of the drill rod or guide adapter is encased inside the mounting sleeve on the drill rod or guide adapter.

3. The drilling assembly according to claim 1, wherein the second wall thickness is at least 1.5 mm.

4. The drilling assembly according to claim 1, wherein the encasing section has a length ($L_1$) and the shoulder has a length ($L_2$), wherein $L_1$ is at least 20% of $L_2$.

5. The drilling assembly according to claim 1, wherein the shoulder has an outer diameter ($D_1$) and the encasing section has an inside diameter ($D_3$), wherein $D_1$ is within the range of 80-100% of $D_3$.

6. The drilling assembly according to claim 1, wherein a clearance between the peripheral surface of the shoulder of the drill rod or guide adapter and an internal surface of the encasing section is between 0.5-4 mm.

7. The drilling assembly according to claim 1, wherein a junction between edges of the peripheral surface of the drill rod or guide adapter and the first annular side surface and a junction between the peripheral surface of the drill rod or guide adapter and the second annular side surface on the shoulder are chamfered.

8. The drilling assembly according to claim 1, wherein the length of the shoulder is between 5-60 mm.

9. The drilling assembly according to claim 1, wherein the male connecting means on the drill rod is a spigot having an externally threaded section and a non-threaded shank positioned axially between the threaded section and the shoulder and wherein the mounting sleeve on the drill bit or the guide adapter is internally threaded.

10. The drilling assembly, according to claim 1, wherein the male connecting means on the drill rod is conical and non-threaded and the mounting sleeve on the drill bit or the guide adapter is internally conical and non-threaded, forming a tapered connection.

11. The drilling assembly according to claim 1, wherein the drill bit or the guide adapter has an outer diameter ($D_4$) at its annular rearward end in the section surrounding the encasing section, wherein $D_4$ is at least 5% greater than the outer diameter ($D_1$) of the shoulder.

12. The drilling assembly according to claim 1, wherein the drill bit or the guide adapter has an outer diameter ($D_4$) at its annular rearward end in the section surrounding the encasing section, and wherein $D_4$ is at least 3 mm greater than $D_1$ up to a maximum of the diameter of the drill bit or guide adapter at its largest cross section.

* * * * *